US008408409B1

(12) United States Patent
Szekely

(10) Patent No.: US 8,408,409 B1
(45) Date of Patent: Apr. 2, 2013

(54) CLOSURE WITH UNITARILY-MOLDED TAMPER-EVIDENT FEATURE

(75) Inventor: Alex S. Szekely, Jackson, NJ (US)

(73) Assignee: Plastek Industries, Inc., Erie, PA (US)

( * ) Notice: Subject to any disclaimer, the term of this patent is extended or adjusted under 35 U.S.C. 154(b) by 0 days.

(21) Appl. No.: 13/227,855

(22) Filed: Sep. 8, 2011

Related U.S. Application Data

(62) Division of application No. 11/627,544, filed on Jan. 26, 2007, now Pat. No. 8,033,419.

(60) Provisional application No. 60/762,378, filed on Jan. 26, 2006.

(51) Int. Cl.

| | |
|---|---|
| ***B65D 47/00*** | (2006.01) |
| ***B65D 41/32*** | (2006.01) |
| ***B65D 51/18*** | (2006.01) |
| ***B65D 43/18*** | (2006.01) |
| ***B65D 85/00*** | (2006.01) |
| ***B65D 51/20*** | (2006.01) |
| ***B65D 25/40*** | (2006.01) |
| ***B67B 1/00*** | (2006.01) |

(52) U.S. Cl. ..... 215/252; 206/459.5; 215/230; 220/266; 220/254.4; 220/257.1; 220/259.3; 220/253; 222/541.5; 222/541.9; 222/153.06; 222/568; 222/548

(58) Field of Classification Search ..... 215/250, 215/253, 230, 44; 220/256.1, 257.1, 257.2, 220/259.3, 259.4, 203.05, 203.16–203.18, 220/266; 222/568, 541.5, 541.9, 519–520, 222/153.01,153.05, 153.06, 153.1, 153.14, 222/566, 548, 567, 153.07, 96, 153.09, 411; 40/311; 206/459.5, 459.1

See application file for complete search history.

(56) References Cited

U.S. PATENT DOCUMENTS

| | | | | |
|---|---|---|---|---|
| 3,439,843 | A * | 4/1969 | Corsette | 222/212 |
| 3,905,509 | A | 9/1975 | Markowitz | |
| 4,489,843 | A | 12/1984 | Drozd, Jr. | |
| 4,570,825 | A | 2/1986 | Stull | |
| 5,088,613 | A * | 2/1992 | Dutt et al. | 215/250 |
| 5,181,632 | A * | 1/1993 | Latter | 222/153.06 |
| 6,024,256 | A | 2/2000 | Beck et al. | |
| 6,170,720 | B1 * | 1/2001 | Gnepper et al. | 222/481.5 |
| 6,279,627 | B1 * | 8/2001 | Kelly | 141/352 |
| 6,422,423 | B1 * | 7/2002 | Rho | 222/111 |
| 6,439,429 | B1 * | 8/2002 | Gross | 222/92 |
| 6,550,626 | B1 | 4/2003 | Randall | |
| 6,631,820 | B2 * | 10/2003 | Harrold et al. | 215/237 |

OTHER PUBLICATIONS

Definition of Valve, Merriam-Webster Dictionary Online, www.merriam-webster.com/dictionary, May 7, 2010.

* cited by examiner

*Primary Examiner* — Robin Hylton
(74) *Attorney, Agent, or Firm* — Bachman & LaPointe, P.C.

(57) ABSTRACT

A bottle closure includes the unitarily-molded combination of: an internally-threaded sidewall; a tamper indicator ring; and a hinge connecting the ring to the sidewall. The hinge permits the ring to be shifted from an initial position to an installation position. The installation position is essentially coaxially aligned with the sidewall.

11 Claims, 10 Drawing Sheets

CLOSURE WITH UNITARILY-MOLDED TAMPER-EVIDENT FEATURE

CROSS-REFERENCE TO RELATED APPLICATION

This is a divisional application of Ser. No. 11/627,544, filed Jan. 26, 2007, and entitled "Closure with Unitarily-Molded Tamper-Evident Feature", the disclosure of which is incorporated by reference herein in its entirety as if set forth at length, and benefit is claimed of Ser. No. 60/762,378, filed Jan. 26, 2006, and entitled "Tamper-Evident Closure", the disclosure of which is incorporated by reference herein in its entirety as if set forth at length.

BACKGROUND OF THE INVENTION

The invention relates to closures. More particularly, the invention relates to tamper-evident screw cap closures for bottles and the like.

A well-developed art exists regarding tamper-evident screw cap closures. A typical closure is molded of a plastic material (e.g., polypropylene, low density polypropylene (LDPE), or high density polyethylene (HDPE)). The closure body typically comprises an internally threaded sidewall portion. A bottom of the sidewall forms a tamper-evident ring. There may be an interrupted or otherwise weakened connection between the ring and adjacent portion of the sidewall. At the upper end of the sidewall main portion, a web may close the closure. Alternatively, any of a number of forms of open valve seat may be formed to which a separate valve element (e.g., a poppet) is movably mounted to open and close the closure.

The closure may be installed to a threaded neck of the bottle by screwing/threading. The screwing may flex/stretch the ring over the bottle external threads. Upon unscrewing of the closure, however, the tensile strength of the connection may be insufficient to draw the ring back over the bottle threads, thereby rupturing the connection and leaving the ring on the bottle. Even upon reinstallation of the remaining portion of the closure, the severed connection provides clear evidence that the closure has previously been opened.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
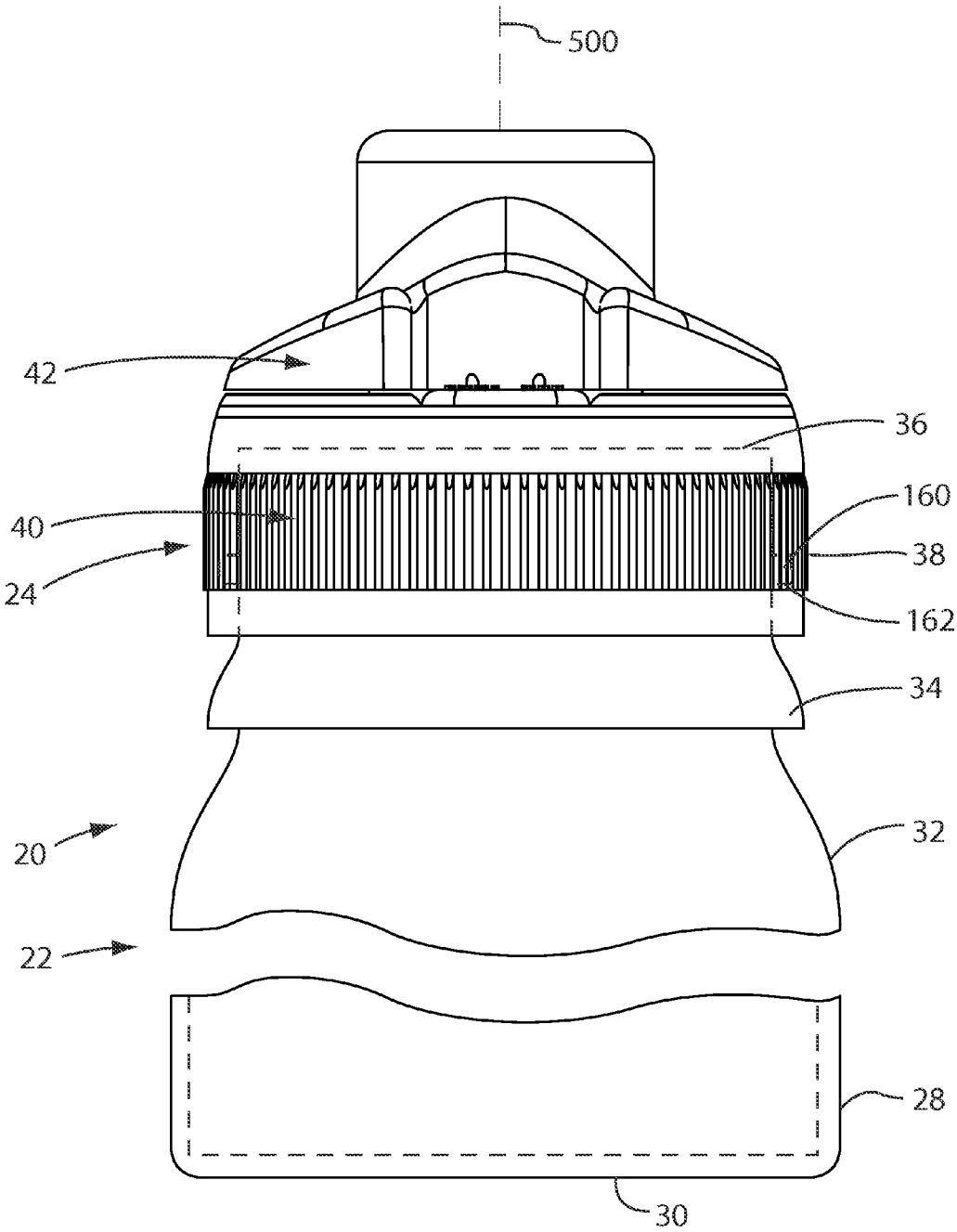
FIG. 1 is a side view of a bottle.
Figure 2:
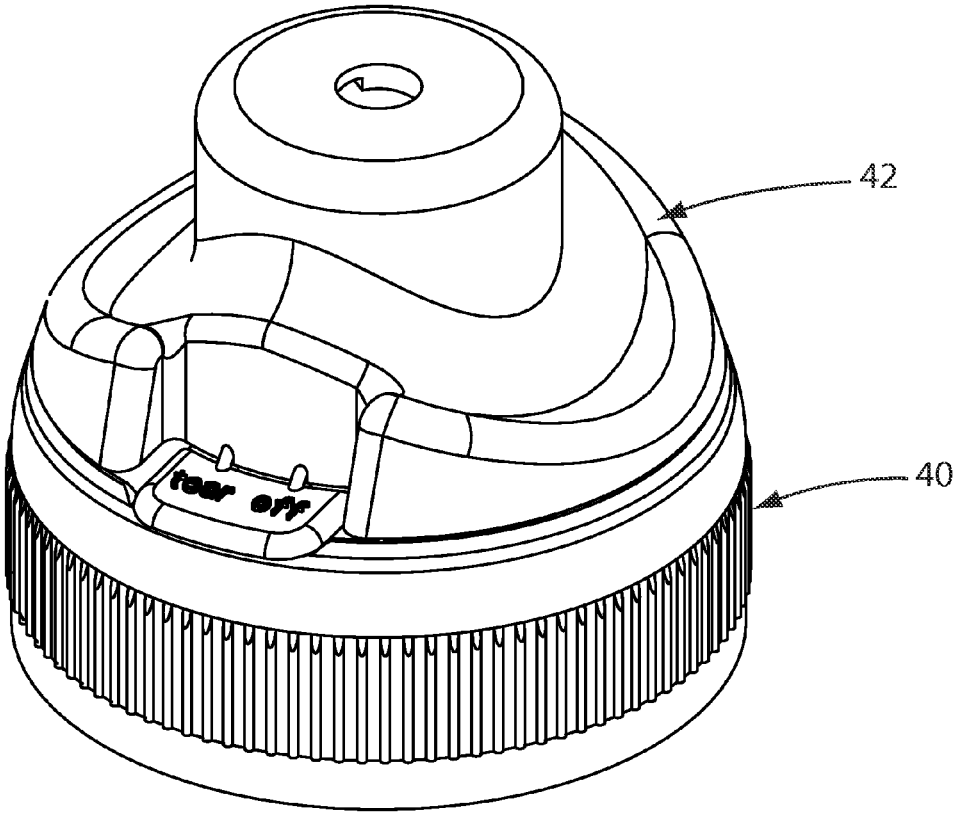
FIG. 2 is a view of a closure of the bottle of FIG. 1.

FIG. 1 shows a container (bottle) 20 as an assembly of a bottle body 22 and a closure assembly 24. The bottle body 22 includes a sidewall 28 extending upward from a bottom or base 30. The exemplary sidewall 28 extends to a shoulder 32. A neck 34 extends above the shoulder to a rim 36 defining a mouth opening. The neck 34 includes an externally threaded portion 38 below the rim 36. The bottle interior may contain a liquid beverage. The exemplary body 22 and closure 24 have a common central vertical/longitudinal axis 500. The exemplary closure 24 is the assembly (main) of a first piece 40 and a second piece 42. As is discussed further below, the exemplary first piece 40 forms a closure body and the exemplary second piece 42 forms a valve element which may be articulated relative to the closure body to open and close the bottle. An exemplary articulation is a relative rotation about the axis 500. An exemplary bottle body 22 is of any conventional yet-developed type and may be unitarily molded from a plastic (e.g., HDPE). The exemplary closure body 40 may similarly be unitarily molded (e.g., of HDPE or MDPE). The valve element 42 may similarly be molded (e.g., of polypropylene).

The closure body 40 may be molded with a live hinge 50 joining a tamper-evident ring 52 to a main portion 54 of the closure body. The hinge 50 defines a hinge axis 502 transverse to and spaced-apart from the central axis 500. First engagement features 56 and 58 on the ring and main body may facilitate screwing the closure body onto the bottle body.

Figure 3:
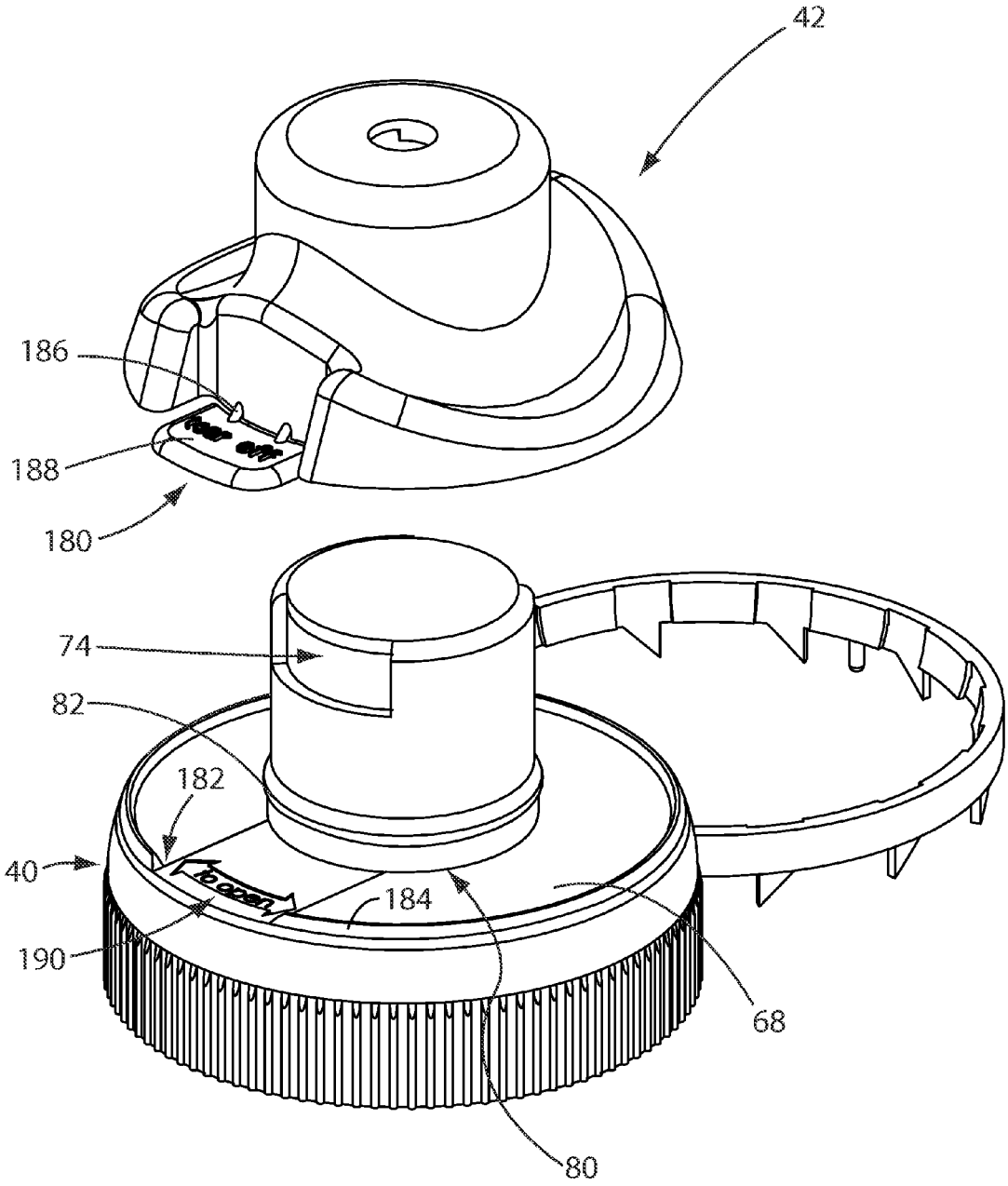
FIG. 3 is an exploded view of the closure of FIG. 2.

The exemplary closure body 40 is a unitary molding. The exemplary main body 54 includes a sidewall 60 having an internal thread 62. The sidewall 60 extends from a lower rim 66 to a shoulder 68. A neck 70 extends upward from the shoulder to a top plate or web 72. The neck includes a pair of radially opposed ports 74 below the web plate 72. Near a base 80 of the neck 70, the neck 70 includes a radially-projecting circumferential retaining rib/barb 82 (FIG. 3) for retaining the valve element 42.

Figure 5:
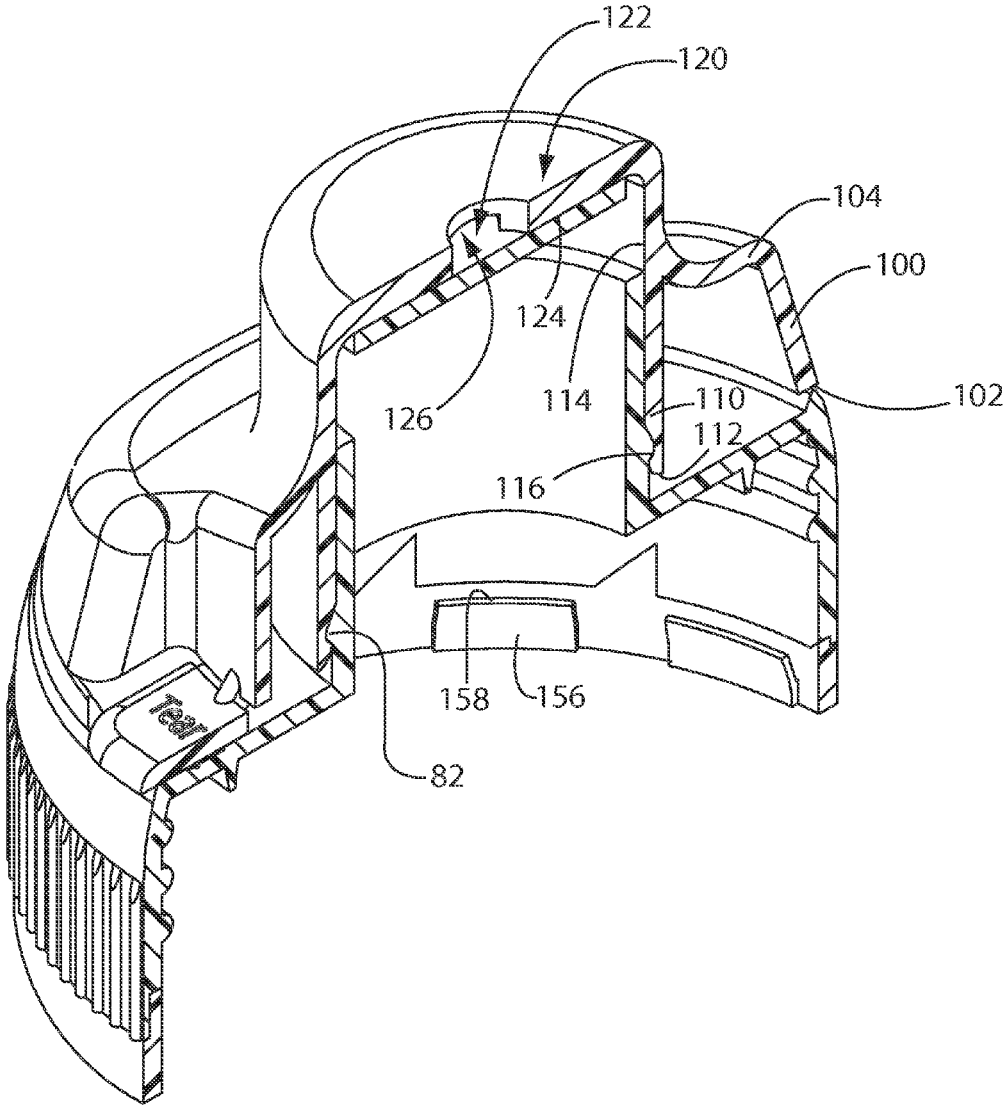
FIG. 5 is a vertical sectional view of the closure of FIG. 2 in an initial closed condition.

The exemplary valve element 42 (FIG. 5) includes an outer skirt or sidewall 100 extending upward from a lower rim 102 to a shoulder 104. The shoulder 104 merges with an intermediate portion of an inner sidewall 110 extending upward from a lower rim 112. The inner sidewall 110 includes an inner/interior surface 114. The interior surface 114 includes a circumferential channel 116 positioned to mate with the rib/barb 82 when the valve element 42 is installed to the body 40.

The exemplary valve element 42 includes a top web/plate 120 at the upper end of the inner sidewall 110. The exemplary web 120 includes a central aperture/port 122. The web 120 has an underside 124. A diametric channel 126 extends along the underside 124 from the port 122. The valve element may be installed to the main body 40 by a translation along the axis 500 to snap the channel 116 into engagement with the rib 82. When installed, the underside 124 may contact the top surface of the web 72. Installation may be in the closed orientation of FIG. 5 wherein the channel 126 is transverse to the ports 74 so that the bottle is sealed by cooperation of the webs. An opening procedure, described in further detail below, rotates the channel 126 into alignment/communication with the ports 74. Alternative valves may open by shifts including a translation or a different rotation.

The body 40 and valve element 42 of the closure 24 may be preassembled to each other and installed to a filled bottle body 22. Alternatively, the closure body 40 may be installed to the bottle body and the bottle may then be filled through the ports 74. Thereafter, the valve element 42 may be installed.

Figure 4:
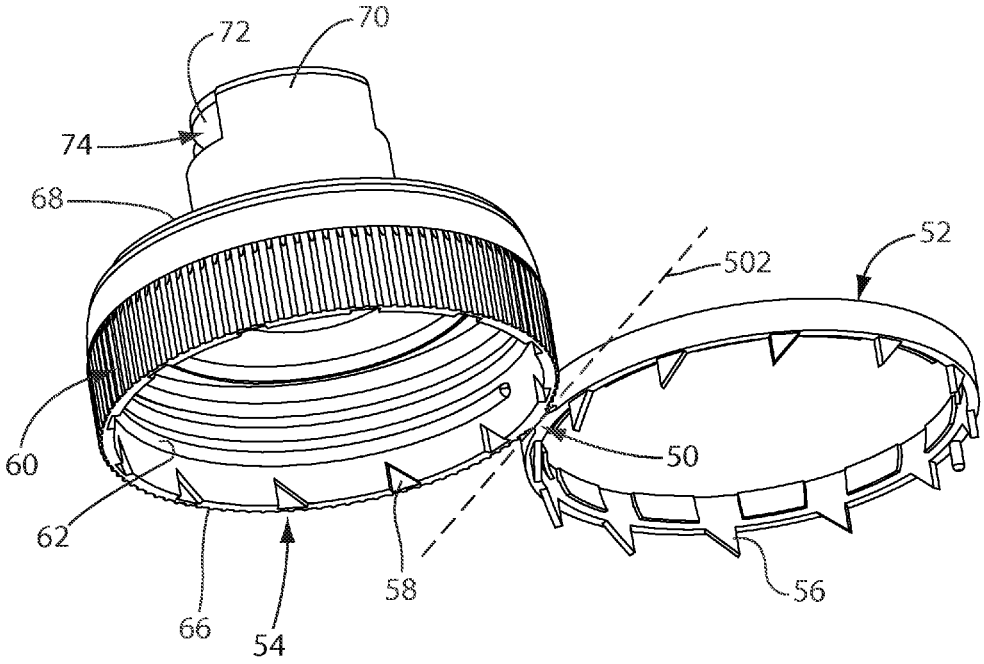
FIG. 4 is a view of a main body of the closure of FIG. 2.
Figure 7:
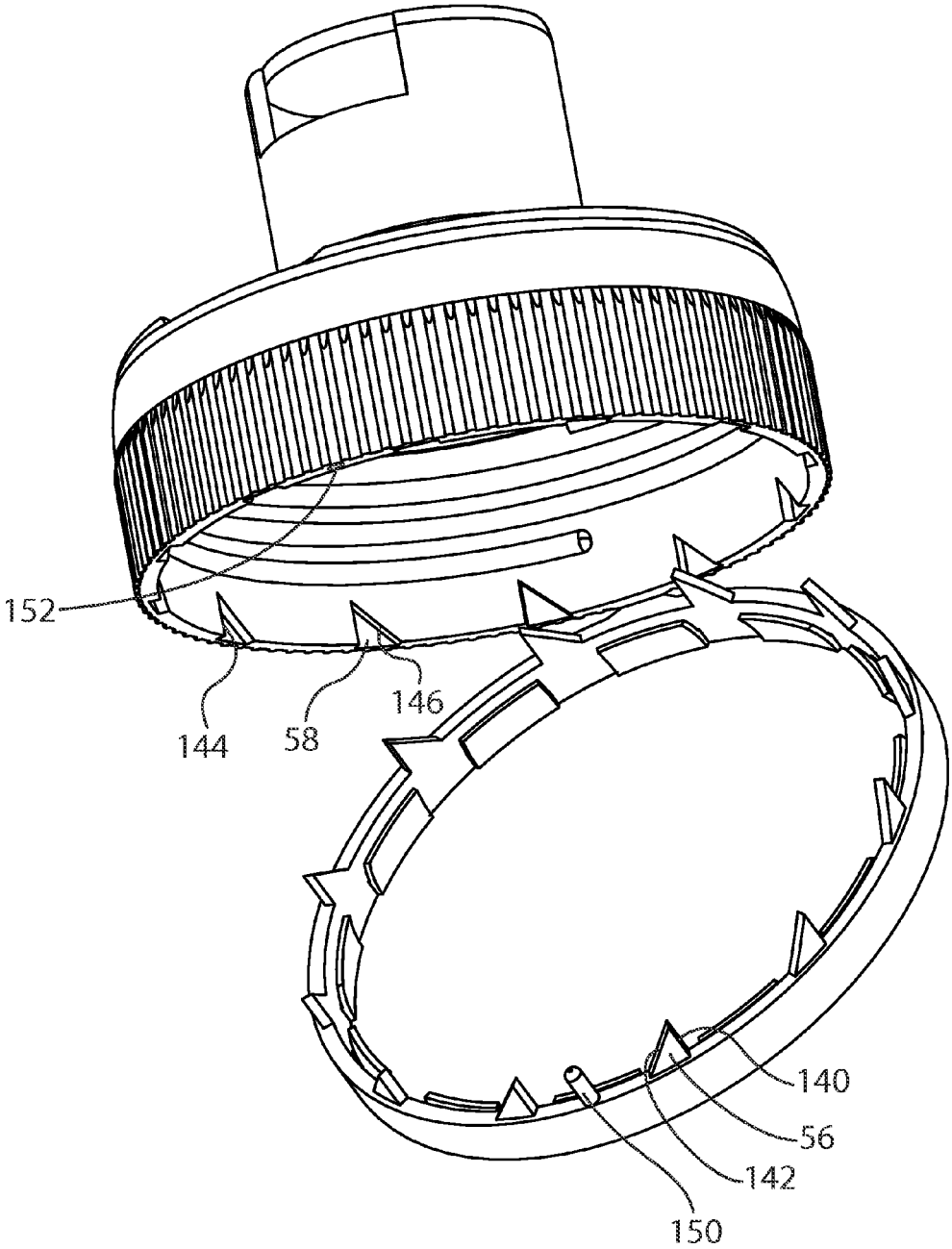
FIG. 7 is a view of the closure main body of FIG. 4 in an intermediate stage.
Figure 8:
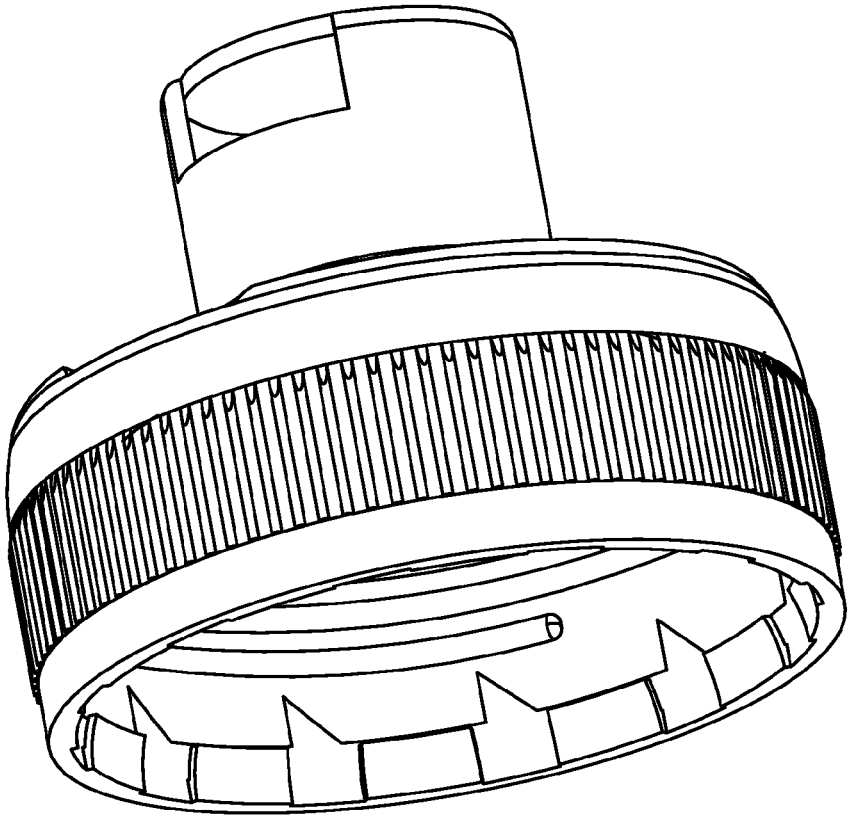
FIG. 8 is a view of the closure main body in a final stage.
Figure 9:
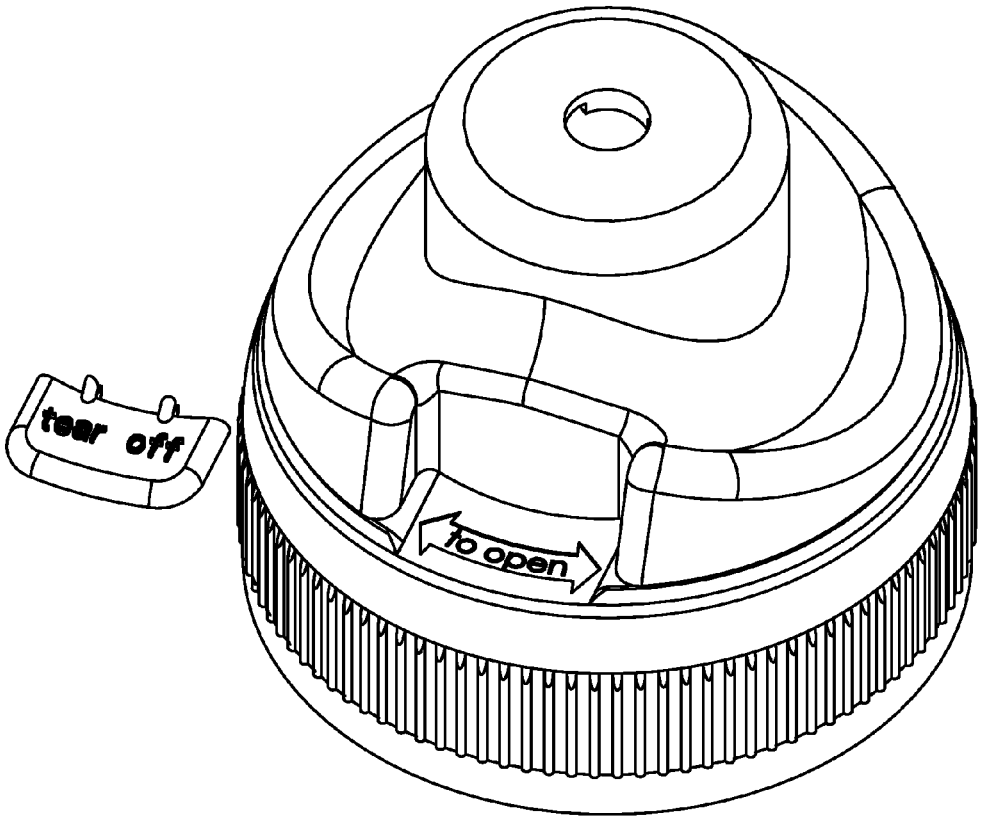
FIG. 9 is a view of the closure in a closed condition showing a tamper evident tab removed.
Figure 10:
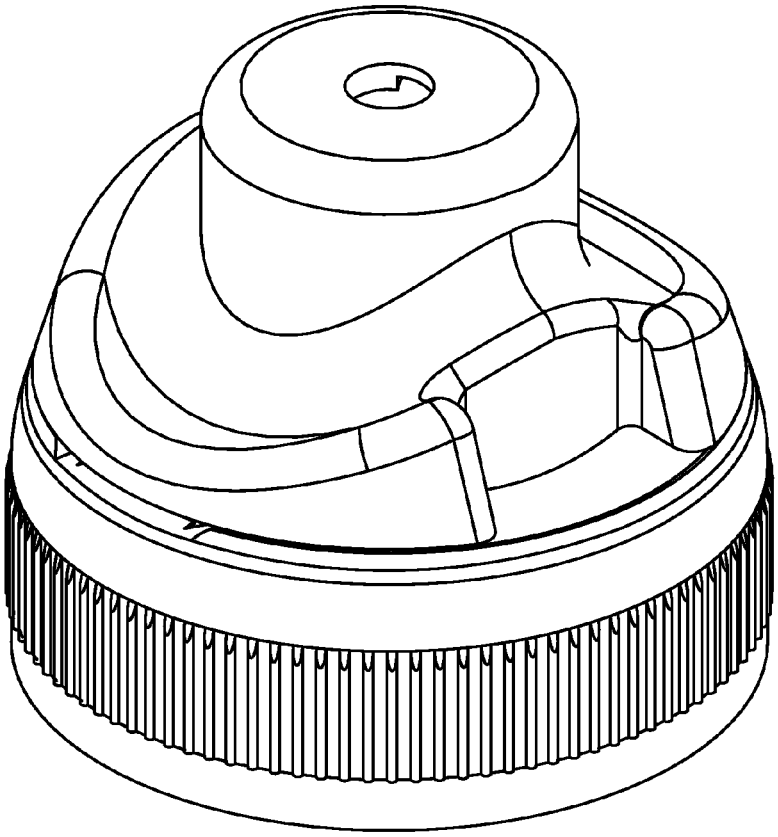
FIG. 10 is a view of the closure of FIG. 9 in an open condition.

FIG. 4 shows the closure body 40 in an approximate as-molded condition. To install the closure body 40 to the bottle main body 22, the ring 52 is rotated about the axis 502 of the hinge 50. FIG. 7 shows an exemplary intermediate stage of that rotation. FIG. 8 shows a final condition. An exemplary rotation is approximately 180° (e.g.,)170°-190°. The final stage of the rotation brings the features 56 and 58 into engagement with each other. Exemplary features 56 are sawtooth projections having first edges 140 and second edges 142. Exemplary features 58 are complementary sawtooth recesses in the interior surface of the sidewall 60 extending upward from the lower rim 66. Exemplary recesses 58 include first edges 144 and second edges 146. The exemplary rotation also brings a locator/retention pin 150 extending from the upper rim of the ring into engagement with a complementary socket 152 extending upward from the lower rim 66. Engagement of the pin 150 with the socket 152 may serve to hold the ring in the FIG. 8 orientation prior to mounting on the bottle main body (e.g., or transport to the bottling line and handling during automated assembly on the line).

As is discussed further below, the exemplary edges 140 and 144 are sufficiently close to vertical or over vertical so as to permit a driving engagement. Specifically, with the projections 56 accommodating the recesses 58, the closure main body may be screwed onto the bottle main body. The engagement causes inward barb projections 156 having upper trailing edges 158 (FIG. 5) to pass over a complementary rib 160 on the bottle neck so that the trailing edges 158 snap into abutting engagement with an underside 162 of the rib. Thereafter, an unscrewing motion will produce one or more of several effects. The engagement between the projections 156 and rib 160 will tend to hold the ring in place as the closure main body 54 is lifted upward by the unscrewing. The relatively shallower angle of the edges 142 and 146 will hinder the transmission of torque between the closure main body 54 and ring 52 and will tend to jack the closure main body 54 off the ring 52. The result will be to sever the live hinge 50 and provide evidence of removal of the closure main body from the bottle.

Such a hinged tamper-evident ring may have one or more of several advantages relative to conventional tamper-evident rings. By at least partially decoupling the frangible/severable connection (e.g., the hinge 50) from the rotation-transmitting connection (e.g., principally the projections 56 and recesses 58), the ring may be much more easily severed. This may increase the reliability of severing the ring when the closure is removed. This is particularly relevant as both bottles and closures become more compliant (e.g., use of softer materials and/or thinning to reduce resource consumption). Also, sensitivity to manufacturing variations may be reduced (e.g., age and wear of molding dies may have a reduced influence on severability of the ring).

Figure 6:
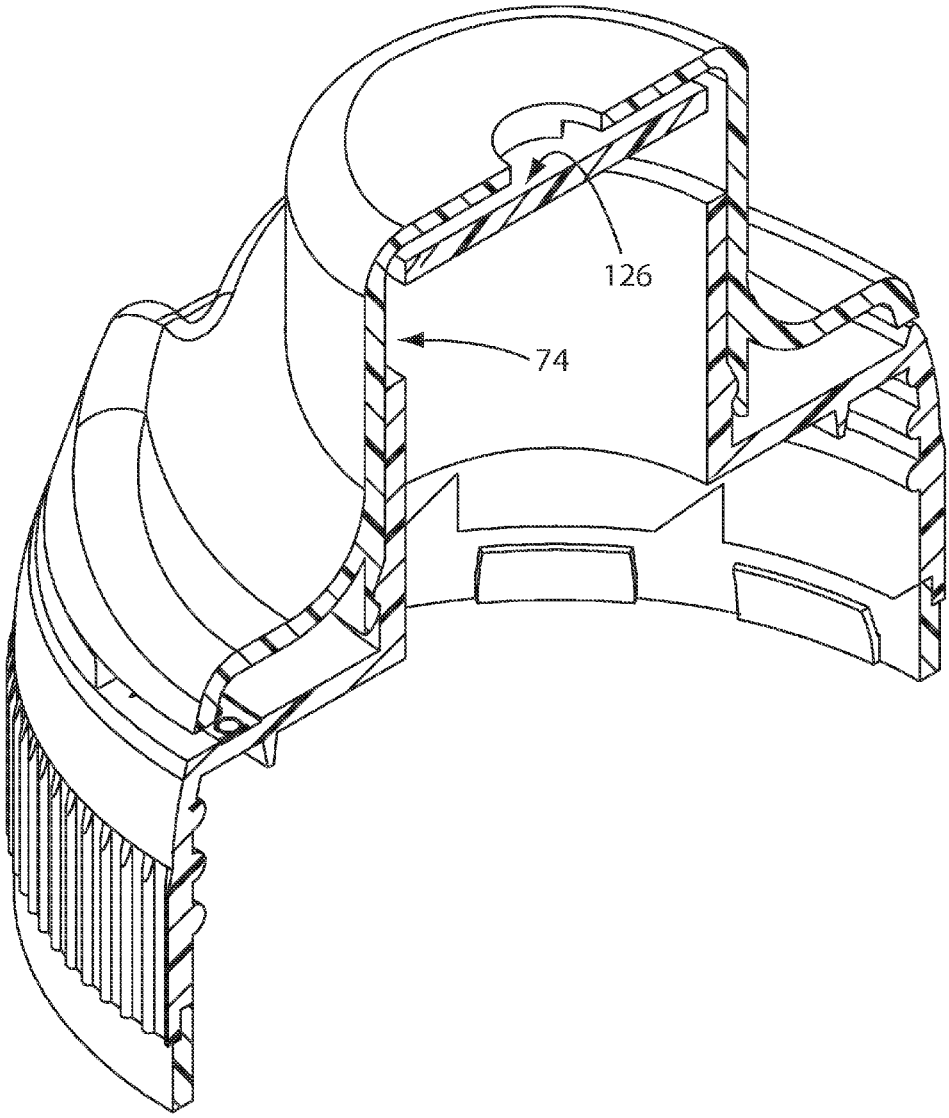
FIG. 6 is a vertical sectional view of the closure of FIG. 2 in an open condition.

The closure assembly may also have a feature for evidencing an attempted opening of the closure assembly (e.g., of the valve element 42 while the closure body 40 remains installed). The exemplary valve element 42 is opened by a rotation relative to the closure body 40 about the axis 500. Exemplary rotations are approximately 90° in either direction. Such a rotation brings the channel 126 into alignment and communication with the ports 74 (FIG. 6). Thus, evidencing the rotation will evidence the opening.

To evidence the valve element rotation and opening, the exemplary closure includes a breakaway tab 180 (FIG. 3) on one of the closure body 40 and valve element 42 which is received by a complementary feature 182 in the other. An exemplary tab 180 is a flat horizontal radially-projecting tab on the valve element 42. An exemplary complementary feature 182 is a recess in a rim 184 at the outer diameter (OD) of the shoulder 68. The exemplary tab 180 includes frangible connections 186 to the remainder of the valve element. The exemplary tab 180 has an upper surface 188 having instruction indicia indicating that the tab must be torn or pulled off by rupturing the connections 186. In the exemplary embodiment, removal of the tab 180 reveals indicia 190 on the shoulder 68 providing instructions to open the valve by rotation in either direction (e.g., a bidirectional circumferential arrow and the word "open"). With the tab 180 in place, engagement with the mating feature 182 prevents or otherwise resists the opening rotation. The indicia 190 may also include express indicia identifying that the product has been opened.

One or more embodiments of the present invention have been described. Nevertheless, it will be understood that various modifications may be made without departing from the spirit and scope of the invention. For example, when implemented as a reengineering of an existing closure and/or for use with an existing bottle body, details of the existing closure or bottle body may influence or dictate details of the particular implementation. Accordingly, other embodiments are within the scope of the following claims.

What is claimed is:

1. A bottle closure comprising:

a main body comprising a first piece having an internally-threaded sidewall for engaging a bottle external thread; and a valve element comprising a second piece mounted to the main body for shifting between open and closed conditions, wherein:

in an initial condition, a first of the main body first piece and valve element second piece has an integrally formed tab engaged by a complementary feature of the other of the main body first piece and valve element second piece, the tab and complementary feature cooperating to resist shifting from the closed condition to the open condition in the absence of severing of the tab;

the valve element has a port in a top web of the valve element;

a channel is formed along an underside of the top web and extending from the port;

the main body comprises ports; and the shifting from the closed condition to the open condition rotates the channel into communication with the main body ports.

2. The closure of claim 1 wherein:

the tab is a radially-projecting tab on the valve element; and in the initial condition, contact between at least one edge of the tab and the complementary feature resists said shifting.

3. The closure of claim 1 wherein:

the shifting is a bi-directional rotation;

the tab is a radially-projecting tab on the valve element; and the complementary feature comprises a gap in a rim portion of the main body.

4. The closure of claim 3 wherein:

the tab and the complementary feature cooperate to resist said shifting from the closed condition to the open condition in the absence of said severing of the tab so that said severing of the tab disengages the tab from the complementary feature and permits the shifting from the closed condition to the open condition.

5. The closure of claim 1 wherein:

the tab and the complementary feature cooperate to resist said shifting from the closed condition to the open condition in the absence of said severing of the tab so that said severing of the tab disengages the tab from the complementary feature and permits the shifting from the closed condition to the open condition.

6. The closure of claim 1 wherein:

the tab is a radially-projecting tab on the valve element;

the complementary feature comprises a recess; and in the initial condition, the tab is accommodated in the recess.

7. The closure of claim 1 wherein:

the tab has an upper surface having instruction first indicia indicating that the tab must be torn or pulled off; and in the initial condition, the main body has, below the tab, second indicia providing instructions to open the valve by bidirectional rotation, the second indicia being revealed by removal of the tab.

8. A bottle comprising:

the closure of claim 1 in the initial condition; and a bottle body having an externally threaded neck threadingly engaged to the internally-threaded sidewall of the main body.

9. A bottle comprising:

a bottle closure comprising:

a main body comprising a first piece having an internally-threaded sidewall for engaging a bottle external thread; and a valve element comprising a second piece mounted to the main body for shifting between open and closed conditions, wherein:

in an initial condition, a first of the main body first piece and valve element second piece has an integrally formed tab engaged by a complementary feature of the other of the main body first piece and valve element second piece, the tab and complementary feature cooperating to resist shifting from the closed condition to the open condition in the absence of severing of the tab; and a bottle body having an externally threaded neck threadingly engaged to the internally-threaded sidewall of the main body, wherein:

the main body comprises:

a shoulder, the sidewall extending from a rim to the shoulder;

a neck extending upward from the shoulder; and a top web, the neck extending to the top web and having a pair of radially opposed ports and having a radially-projecting retaining rib retaining the valve element; and the valve element comprises:

a sidewall; and a top web at the upper end of the sidewall and having a central aperture, an underside, and a channel along the underside from the aperture, wherein:

in the closed condition, the closure is sealed by cooperation of the main body top web and valve element top web and, in the open condition, the channel is in alignment/communication with the ports.

10. A bottle closure comprising:

a main body having an internally-threaded sidewall for engaging a bottle external thread; and a valve element mounted to the main body for shifting between open and closed conditions, wherein:

in an initial condition, a first of the main body and valve element has an integrally formed tab engaged by a complementary feature of the other of the main body and valve element, the tab and complementary feature cooperating to resist shifting from the closed condition to the open condition in the absence of severing of the tab;

the tab has an upper surface having instruction first indicia indicating that the tab must be torn or pulled off; and in the initial condition, the main body has, below the tab, second indicia providing instructions to open the valve by bidirectional rotation, the second indicia being revealed by removal of the tab.

11. A bottle closure comprising:

a main body comprising a first piece having an internally-threaded sidewall for engaging a bottle external thread; and a valve element comprising a second piece mounted to the main body for shifting between open and closed conditions, wherein:

in an initial condition, a first of the main body first piece and valve element second piece has an integrally formed tab engaged by a complementary feature of the other of the main body first piece and valve element second piece, the tab and complementary feature cooperating to resist shifting from the closed condition to the open condition in the absence of severing of the tab;

the tab has an upper surface having instruction first indicia indicating that the tab must be torn or pulled off; and in the initial condition, the main body has, below the tab, second indicia providing instructions to open the valve by bidirectional rotation, the second indicia being revealed by removal of the tab.

* * * * *